US005638708A

United States Patent [19]

Hsu

[11] Patent Number: 5,638,708

[45] Date of Patent: Jun. 17, 1997

[54] COMBINATION LOCK WITH LATCH BOLT

[76] Inventor: Chung-Tang Hsu, No. 103, Wu-Kong Rd., Wu-Ku Ind. Park, Taipei Hsien, Taiwan

[21] Appl. No.: 622,629

[22] Filed: Mar. 27, 1996

[51] Int. Cl.[6] ..... E05B 65/44

[52] U.S. Cl. ..... 70/84; 70/138; 70/213; 70/312

[58] Field of Search ..... 70/85, 84, 88, 70/138, 213, 312

[56] References Cited

U.S. PATENT DOCUMENTS

| | | | |
|---|---|---|---|
| 802,062 | 10/1905 | Vieweg | 70/312 |
| 1,567,901 | 12/1925 | Blair | 70/312 |
| 1,586,496 | 5/1926 | Wildrick | 70/312 |
| 2,119,704 | 6/1938 | Denerich | 70/213 |
| 3,543,545 | 12/1970 | Budzyn | 70/312 |
| 3,545,238 | 12/1970 | Gehrie et al. | 70/312 |
| 4,123,923 | 11/1978 | Bako | 70/74 |
| 4,646,547 | 3/1987 | Scelba et al. | 70/312 |
| 4,852,371 | 8/1989 | Pfeiffer | 70/70 |

FOREIGN PATENT DOCUMENTS

| | | | |
|---|---|---|---|
| 365822 | 5/1990 | European Pat. Off. | 70/312 |

*Primary Examiner*—Steven N. Meyers
*Assistant Examiner*—Donald J. Lecher
*Attorney, Agent, or Firm*—Bacon & Thomas

[57] ABSTRACT

A combination lock device with latch bolt includes a combination lock, a rotary rod means, a faceplate, a securing seat, a turning means, a slide piece, a latch bolt and a housing. In order to unlock the combination lock, number dials are turned to a preset code number so that a lock hook disengages from a retain slot of the faceplate. The user may then turn the combination lock counter-clockwisely to cause the turning means to turn therewith, so that a connecting piece at a bottom side of the rotary rod means also rotate, causing a notch of the connecting piece to push a post of a turning piece to displace through 90 degrees. A slide piece is caused to displace forwardly as a result of the post pushing a slide slot, so that a movable pin on two U-shaped indentations of the slide piece displaces upwardly and then downwardly by means of a spring, causing the latch bolt to retract into the housing. Locking may be achieved by reverse operation.

8 Claims, 3 Drawing Sheets

COMBINATION LOCK WITH LATCH BOLT

BACKGROUND OF THE INVENTION

1. Field of the Invention

The present invention relates generally to a combination lock, and more particularly to a combination lock with latch bolt.

2. Description of the Prior Art

Conventional locks for doors, office cabinets and desks are generally used in conjunction with keys. If the keys are lost, it will be a problem to open the locks. Conventional locks with latch bolts are usually adopted in sliding doors consisting of a front door portion and a rear door portion slidably connected together. The lock is generally installed at one side of the front door. When the user inserts a key into a keyway of the lock, he/she has to turn the key through 270 degrees and then through another 90 degrees to cause a projection at a bottom side of the lock to force a slide piece to displace, thereby causing a latch bolt to extend rearwardly to fasten a retain hole in the rear door portion. In order to open the lock, the key is turned reversely to cause the latch bolt to retract so that the sliding door may be slidably pulled open sideways.

SUMMARY OF THE INVENTION

Accordingly, a primary object of the present invention is to provide a combination lock with latch bolt for office cabinets or desks with sliding doors to eliminate use of keys.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
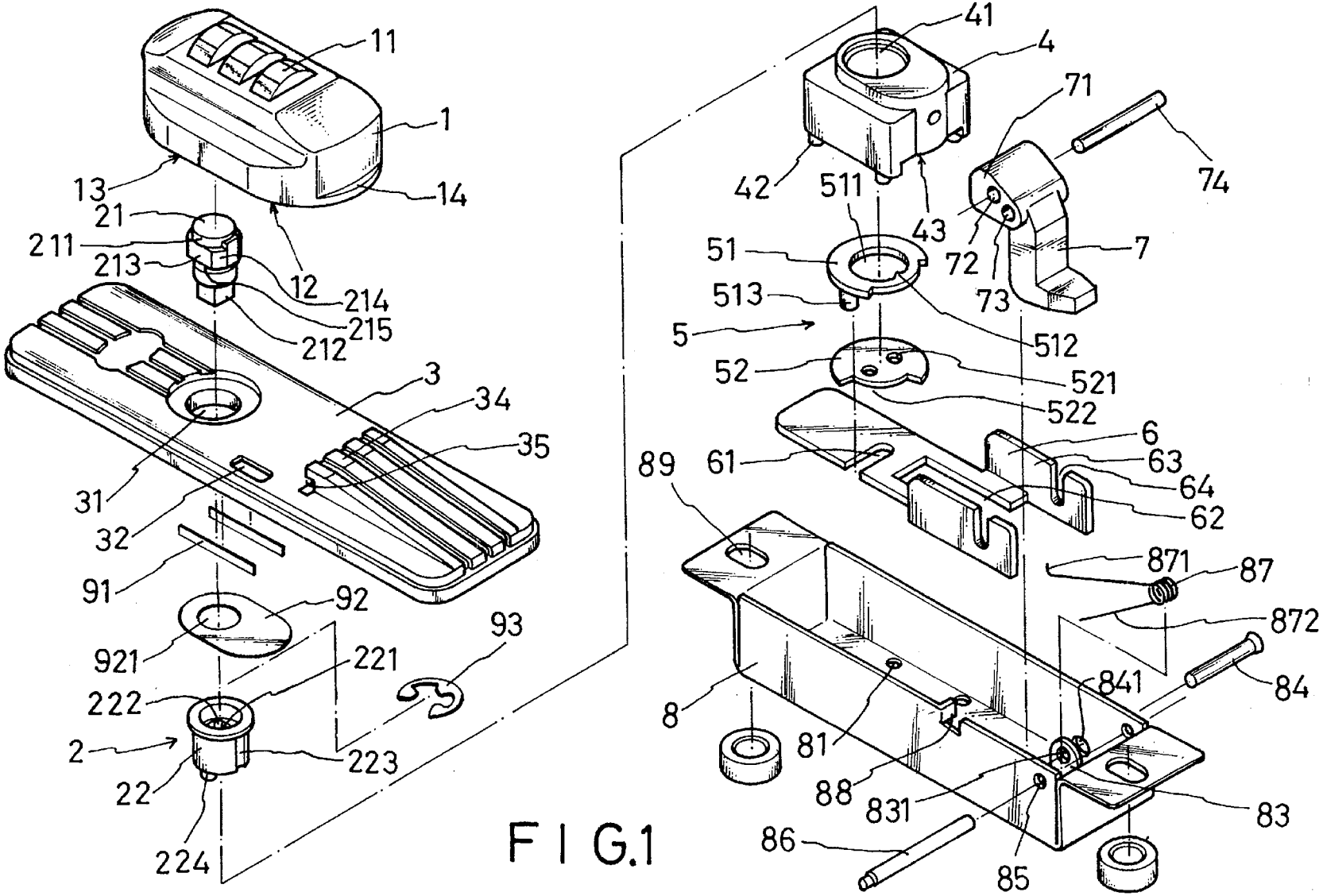
FIG. 1 is an elevational, exploded view of the combination lock device of the present invention.

With reference to the drawings, the combination lock device according to the present invention essentially comprises a combination lock 1, a rotary rod means 2, a faceplate 3, a securing seat 4, a turning means 5, a slide piece 6, a latch bolt 7 and a housing 8.

The combination lock 1 is a conventional mechanical combination lock. It has multiple number dials 11 provided thereon. Its bottom has a lock hook 12 extending from one side thereof for fastening with the faceplate 3. A positioning hole 13 (not shown) is formed at the other side of its bottom for connection with the rotary rod means 2. When the number dials 11 are turned to a preset code number, the lock hook 12 may retract inwardly. And when any one of the number dials 11 is turned, the lock hook 12 will project from the bottom of the combination lock 1 to engage the faceplate 3.

The rotary rod means 2 consists of a linkage rod 21 and a mounting seat 22 coupled together. The linkage rod 21 has a boss 211 formed at an upper end thereof for coupling with the positioning hole 13 and a polygonal portion 212 at lower end thereof for passing through the faceplate 3 to fit into the mounting seat 22. The mounting seat 22 is provided with a mounting hole 221 for matching the polygonal portion 212 inserted therein. In order to facilitate positioning during assembly, the polygonal portion 212 has one corner thereof milled to form a planar surface 213. Correspondingly, the mounting hole 221 is provided with a planed surface 222 to facilitate positioning. At the same time, a vertical slot 223 is formed at one side of the mounting seat 22. Two projections 224 are also provided to extend downwardly from a bottom of the mounting seat 22 for connection with the turning means 5 within the securing seat 4.

The faceplate 3 is an elongate strip structure and has a plate hole 31 at a suitable position for passage of the linkage rod 21. It is also provided with a retain hole 32 for receiving the lock hook 12. In addition, the faceplate 3 has a raised decorative strip 34 at one side thereof, and a groove 35 is also provided for accommodating and positioning a lock rim 14 of the combination lock 1. The faceplate 3 is further provided with conventional screw rods 36 at both the front and the rear ends of a bottom thereof for passing through the housing 8 to be locked into a door plate.

The securing seat 4 is a hollow structure provided with a seat hole 41 for matching the mounting seat 22, which passes therethrough to be coupled with the turning means 5 at a bottom side of the securing seat 4. The securing seat 4 has multiple pins 42 at the bottom thereof for insertion into corresponding holes formed in the housing 8. Two slots 43 are respectively formed at the front and rear ends thereof for horizontal displacement of the slide piece 6.

The turning means 5 is consisted of a turning piece 51 having a hole 511 for receiving the mounting 22 such that a lug 512 of the hole 511 just fits into the slot 223 at one side of the mounting seat 22 to achieve linking-up movement. The projections 224 at the bottom of the mounting seat 22 are fitted into two corresponding holes 521 formed at a connecting piece 52 located below the turning piece 51. The connecting piece 52 is configured to have a 90-degree sector-like notch 522 at its periphery to facilitate pushing of a post 513 projecting from a lower side of the turning piece 51.

The slide piece 6 consists of a horizontal portion and two wings 63, which are substantially perpendicular thereto. The width of the slide piece 6 corresponds to that of the slots 43 of the securing seat 4 and the slide piece 6 is accommodated at the bottom of the securing seat 4. A slide slot 61 is transversely formed at a suitable position of the slide piece 6 for matching the post 513 of the turning piece 5 so that the post 513 may extend into the slide slot 51 to push the slide piece 6. A middle section of horizontal portion of the slide piece 6 is a slide notch 62 for passage of the latch bolt 7 when it extends or retracts. The wings 63 are disposed at both sides of the horizontal portion, each of which has a U-shaped indentation 64 for supporting the latch bolt 7.

The latch bolt 7 is a substantially L-shaped hook-like structure having a head portion 71 provided with a first through hole 72 and a second through hole 73; a movable pin 74 is passed through the second through hole 72 and mounted astride the U-shaped indentations 64.

The housing 8 is a box structure with an open top. Its size matches that of the faceplate 3. Its bottom is provided with multiple holes 81 for matching the pins 42 of the securing seat 4. It is also provided with an elongate slot 82 (see FIG. 2) for matching the slide notch 62 for projection of the latch bolt 7. Two opposite ends at a front portion of the slot 82 are respectively provided with a protrudent wing 83 with a wing hole 831. A positioning pin 84 is passed through a pin hole 841 disposed in a parallel relationship to the wing holes 831, the wing holes 831 and the second through hole 73, so that the latch bolt 7 may, relative to the housing 8, extend or retract. In addition, two through holes 85 are respectively formed at opposite sides of the housing 8 near its front portion for passage of a retain pin 86, which passes through the through holes 85 and a spring 87 disposed between the through holes 85, so that a first end 871 of the spring 87 engages a lug 88 of the housing 8 and a second end 872 urges against the movable pin 74 so that the latch bolt 7 may not disengage from the U-shaped indentations 64. The housing 8 is also provided with two side holes 89 for matching the screw rods 36, which pass therethrough to lock onto the door plate.

Furthermore, the combination lock device of the present invention comprises a positioning means, which consists of two milled surfaces 213 and two curved surfaces 214 formed at the linkage rod 2, with a groove 215 provided at a lower portion. The faceplate 3 is correspondingly provided with two positioning resilient pieces 91 insertably fitted to the bottom thereof. When the two milled surfaces 213 and the two positioning resilient pieces 91 contact, it is in a locked state. When the curved surfaces 214 contact the positioning resilient pieces 91, the latter will stretch outwardly and generate a sound; it is then in an unlocked state. In addition, in order to prevent the resilient pieces 91 from slipping out, a baffle piece 92 with a through hole 921 is provided below them. The linkage rod 21 is passed through the through hole 921, and a C-clip 93 is fastened onto the groove 215 of the linkage rod 21 to prevent the baffle piece 92 from disengaging from the linkage rod 21, thereby also preventing the resilient pieces 91 from separating from the faceplate 3.

Figure 2:
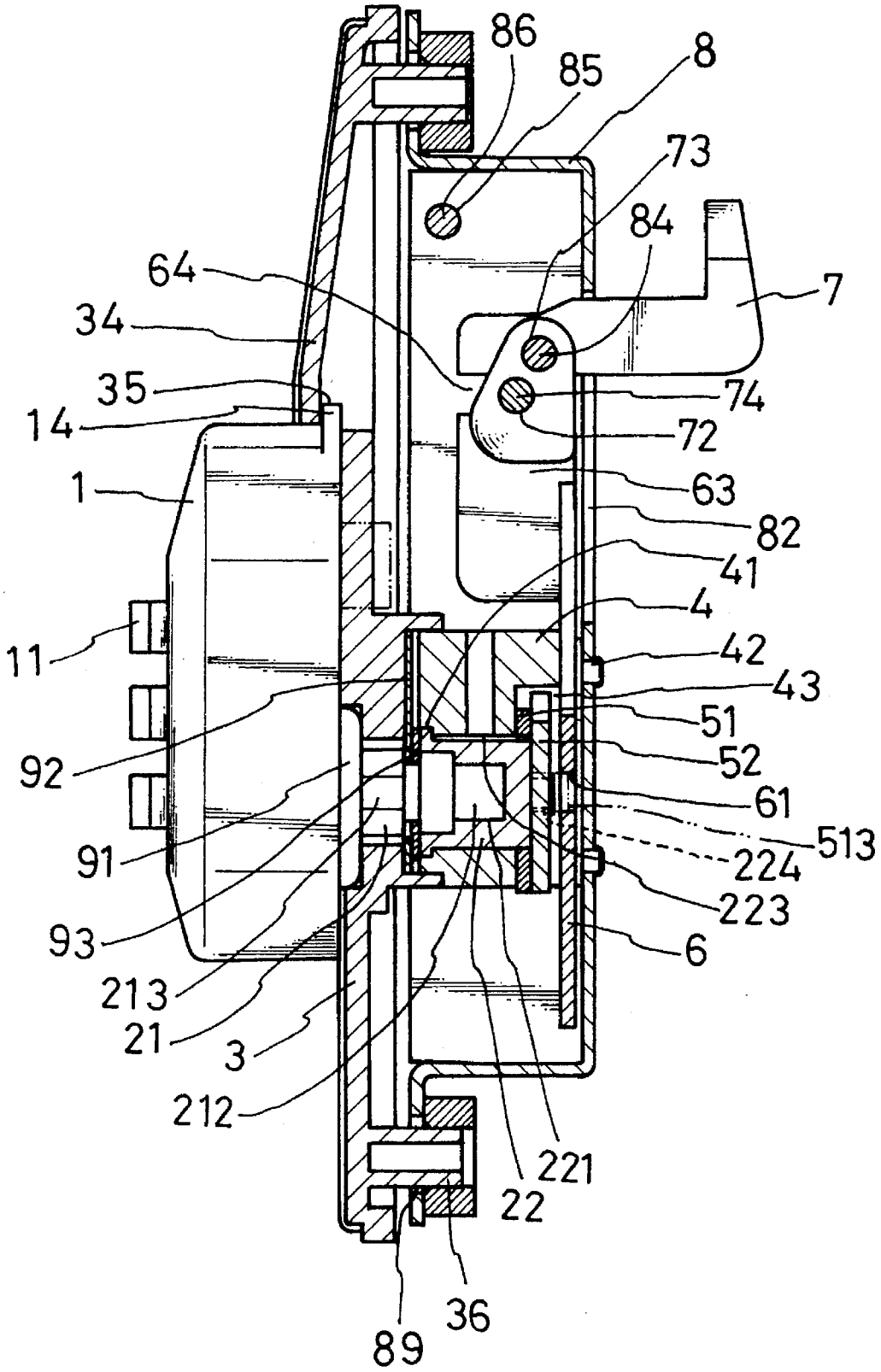
FIG. 2 is a sectional schematic view of the invention in an assembled state.
Figure 4:
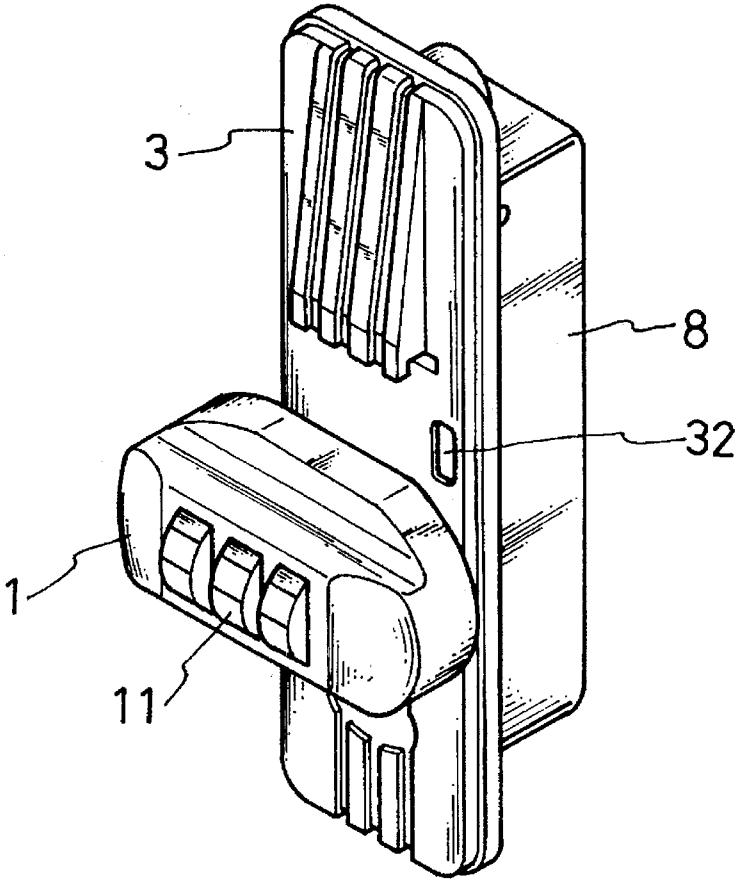
FIG. 4 is an elevational view of the invention in an unlocked state.
Figure 3:
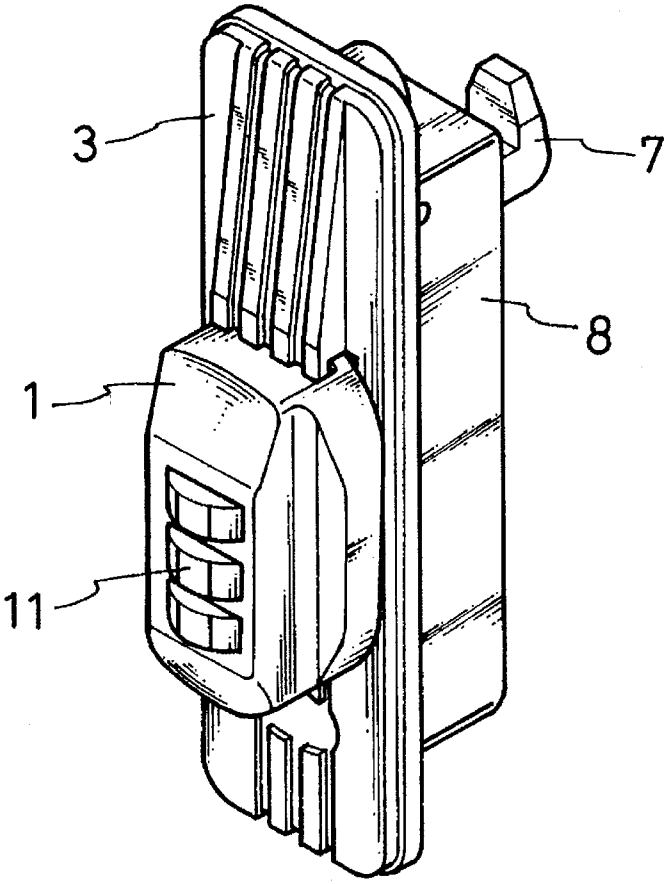
FIG. 3 is an elevational view of the invention in a locked state.

With reference to FIGS. 2 and 3, in order to open the lock, the number dials 11 are turned to a set code number so that the lock hook 12 disengages from the retain hook 32. The user may then turn the combination lock 1 counterclockwisely so that the rotary rod means 2 also rotates therewith, causing its bottom and the connecting piece 52 connected thereto rotate. The fan-shaped notch 522 thereof may then pushes the post 513 to displace through 90 degrees so that the slide piece 6 is caused to displace forwardly due to the pushing action of the post 513 on the slide slot 61. The movable pin 74 is forced to displace upwardly from the U-shaped indentations and is subsequently forced to move downwardly by the second end 872 of the spring 87, causing the latch bolt 7 to retract into the housing 8. The lock is then at a state as shown in FIG. 4. On the contrary, if the combination lock device of the invention is to be locked, the number dials 11 are turned clockwisely through 90 degrees, so that the fan-shaped notch 522 pushes the post 513 reversely, causing the slide piece 6 to displace rearwardly, thus forcing the latch bolt 7 to project outwardly to be retained in a hole pre-formed in the door plate. At this point, by turning any one of the number dials 11, the lock hook 12 will extend to engage the retain slot 32 to achieve a locked state.

In the present invention, when the combination lock device in a locked state, the combination lock is at a same plane with the faceplate; but when it is in an unlocked state, the combination lock is at a right angle to the faceplate. Such an arrangement enables the user to identify easily whether the combination lock is locked or unlocked.

Although the present invention has been illustrated and described with reference to the preferred embodiment thereof, it should be understood that it is in no way limited to the details of such embodiment but is capable of numerous modifications within the scope of the appended claims.

What is claimed is:

1. A combination lock device with latch bolt comprising:

a combination lock having multiple number dials provided thereon, a lock hook being disposed at one side of a bottom of said combination lock, and a positioning hole being disposed at the other side thereof;

a rotary rod comprising a linkage rod connected to said positioning hole for synchronous movement, said linkage rod has a polygonal portion at a lower end thereof, which passes through a plate hole of a faceplate and fits into a mounting hole of a mounting seat, said mounting seat having two projections at a lower end thereof;

said faceplate, being an elongate strip structure and having a size matching that of said combination lock, said faceplate being provided with said plate hole for passage of said linkage rod and a retain slot for receiving said lock hook;

a securing seat having a through seat hole for accommodating said rotary rod means and multiple pins at a bottom side thereof, said securing seat being provided with two slots respectively disposed at a rear end and a front end thereof for receiving a slide piece;

said rotary rod further comprising a turning piece having a hole for receiving said mounting seat and a post at a bottom side thereof fitted, said projections at the bottom side of the mounting seat being fitted into a couple of corresponding holes of a connecting piece located beneath said turning piece to achieve synchronous movement, said connecting piece being configured to have a fan-shaped notch for pushing said post of said turning piece;

said slide piece, consisting of a horizontal portion and two vertical wings, said slide piece having one end thereof received in said slots of said securing seat, a transverse slide slot being formed at one side of the horizontal portion for passage of said post of said turning piece therethrough to push said slide piece, a notch being formed to the front of said slide slot, and said wings being disposed at both sides of said notch, each of said wings having a U-shaped indentation;

a latch bolt of a substantially L-shaped lock structure, said latch bolt having a head portion provided with a first through hole and a second through hole, a movable pin being passed through said first through hole to mount astride said U-shaped indentations so that said latch bolt may pass through said notch of said slide piece; and a housing, being an open-top box structure with multiple holes in a bottom side thereof for receiving and positioning said pins of said securing seat, said housing being provided with a slot at a suitable position for matching said notch of said slide piece to allow extension of said latch bolt, two wings projecting respectively from two opposite ends of a front portion of said slot of said housing, each of said wings having a wing hole, a positioning pin being passed through said wing holes and said second through hole of said latch bolt; said housing being further provided with two through holes at opposite ends of a front portion thereof for passage of a retain pin which passes through said through holes of said housing and a spring disposed between said through holes of said housing, such that a first end of said spring engages a lug of said housing and a second end thereof urging against said movable pin;

number dials for turning to a preset code number, said lock hook disengages from said retain hole, and by turning said combination lock, said rotary rod and said number dials accommodated inside said housing synchronously turn therewith to cause said post of said turning piece to be pushed by said notch of said connecting piece, thereby forcing said slide piece in said slide slot to displace and said latch bolt to retract into said housing, unlocking said combination lock.

2. A combination lock device as claimed in claim 1, wherein said linkage rod is provided with a milled surface and said mounting seat is provided with a planed surface to facilitate positioning of said linkage rod in said mounting seat.

3. A combination lock device as claimed in claim 1, wherein said faceplate is provided with a raised, decorative strip at one side thereof and a groove for receiving a lock edge of said combination lock.

4. A combination lock device as claimed in claim 1, wherein said mounting seat has a slot formed in an outer side wall thereof, and said hole of turning piece is provided with a lug for fitting into said slot to achieve linking-up movement.

5. A combination lock device as claimed in claim 1, wherein said faceplate is provided with two screw rods extending respectively from both sides thereof for passing through two side holes of said housing to facilitate locking with a door plate.

6. A combination lock device as claimed in claim 1, wherein said connecting piece is an annular structure with a 90 degree sector-like notch at its periphery.

7. A combination lock device as claimed in claim 1, further comprising a positioning means, said means consisting of two milled surfaces and curved surfaces formed on said linkage rod, and two positioning resilient pieces insertably provided at a bottom side of said faceplate, such that when said milled surfaces contact said resilient pieces, said combination lock is in a locked state; and when said curved surfaces contact said resilient pieces, said resilient pieces stretch outwardly and generate a sound, indicating said combination lock is in an unlocked state.

8. A combination lock device as claimed in claim 7, wherein a groove is formed below said milled surfaces of said linkage rod so that when said linkage rod passes through a through hole of a baffle plate, a c-clip may fasten onto said groove, preventing said baffle piece from separating from said linkage rod and preventing said resilient pieces from slipping out.

* * * * *